US006340064B2

(12) United States Patent
Fielder et al.

(10) Patent No.: US 6,340,064 B2
(45) **Date of Patent: *Jan. 22, 2002**

(54) BI-CENTER BIT ADAPTED TO DRILL CASING SHOE

(75) Inventors: Coy M. Fielder, Cypress; Rogerio H. Silva, Spring, both of TX (US)

(73) Assignee: Diamond Products International, Inc., Houston, TX (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/392,043

(22) Filed: Sep. 8, 1999

Related U.S. Application Data

(60) Provisional application No. 60/118,518, filed on Feb. 3, 1999.

(51) Int. Cl.[7] ..... E21B 10/26
(52) U.S. Cl. ..... 175/385; 175/391
(58) Field of Search ..... 175/385, 334, 175/391, 399

(56) References Cited

U.S. PATENT DOCUMENTS

| | | | | |
|---|---|---|---|---|
| 5,678,644 A | * | 10/1997 | Fielder | 175/391 |
| 5,957,223 A | * | 9/1999 | Doster et al. | 175/57 |
| 5,992,548 A | * | 11/1999 | Silva et al. | 175/391 |
| 6,039,131 A | * | 3/2000 | Beaton | 175/376 |

* cited by examiner

*Primary Examiner*—William Neuder
(74) *Attorney, Agent, or Firm*—Sankey & Luck L.L.P.

(57) ABSTRACT

A bi-center bit adapted to be consecutively used in casing and in formation without the need of removing the bit from the borehole, the bit comprising a bit body defining a proximal end adapted for connection to a drill string, a distal end and a pass-through gauge, where the distal end defines a pilot bit and an intermediate reamer section, where each the pilot and reamer section define a cutting face. A plurality of cutting or wear elements are situated on cutting blades disposed about the cutting face of the pilot and reamer sections. Cutting or wear elements are disposed on one or more of the blades which extend to or are proximate to the pass-through gauge define an angle between the line of contact on the cutting or wear element and the material to be drilled of between 5–45 degrees.

35 Claims, 10 Drawing Sheets

BI-CENTER BIT ADAPTED TO DRILL CASING SHOE

CROSS-REFERENCE TO RELATED APPLICATIONS

This application depends from and incorporates the subject matter of provisional application Serial No. 60/118,518 as filed on Feb. 3, 1999.

BACKGROUND OF THE INVENTION

1. Field of the Invention

The present invention is directed to downhole tools. More specifically, the present invention is directed to a bi-center drilling bit adapted to fit within and drill through a casing shoe without damage to the surrounding casing.

2. Background

Bi-center bits are adapted for insertion down a wellbore having a given diameter where, once in position, the rotation of the bi-center bit creates a borehole having a selectedly greater diameter than the borehole.

In conventional bi-center bits, the bit is designed to rotate about a rototial axis which generally corresponds to the rotational axis defined by the drill string. Such conventional designs are further provided with cutting elements positioned about the face of the tool to reveal a low backrake angle so as to provide maximum cutting efficiency.

Disadvantages of such conventional bi-center bits lie in their inability to operate as a cutting tool within their pass-through diameter while still retaining the ability to function as a traditional bi-center bit. In such a fashion, a conventional bi-center bit which is operated within casing of its pass-through diameter will substantially damage, if not destroy the casing.

SUMMARY OF THE INVENTION

The present invention addresses the above and other disadvantages of prior bi-center drilling bits by allowing selective modification of the use of the tool within the borehole.

In one embodiment, the present invention includes a drill bit body which defines a pilot section, a reamer section and a geometric axis. The pilot section defines a typical cutting surface about which is disposed a plurality of cutting elements. These elements are situated about the cutting face to generally define a second rototional axis separate from the rotational axis defined by the drill string as a whole. This second or pass-through axis is formed by the rotation of the bit about the pass-through diameter.

In one embodiment, the pilot section may define a smaller diametrical cross-section so as to further prevent the possibility of damage to the borehole and/or casing when the bit is rotated about the pass-through axis. To further accomplish this goal, a gauge pad may also be situated on the drill bit body opposite the reamer. In yet other embodiments, cutters emphasizing a high back rake angle are employed on the peripheral cutting blades of the tool.

The present invention presents a number of advantages over prior art bi-center bits. One such advantage is the ability of the bi-center bit to operate within a borehole or casing approximating its pass-through diameter without damaging the borehole or casing. In the instance of use in casing, the casing shoe may thus be drilled through.

A second advantage is the ability of the same tool to be used as a conventional bi-center bit to create a borehole having a diameter greater than its pass-through diameter. In such a fashion, considerable cost savings may be observed since only one tool need be used where this tool need not be retrieved to the surface to modify its character of use.

Other advantages of the invention will become obvious to those skilled in the art in light of the figures and the detailed description of the preferred embodiments.

Figure 1:
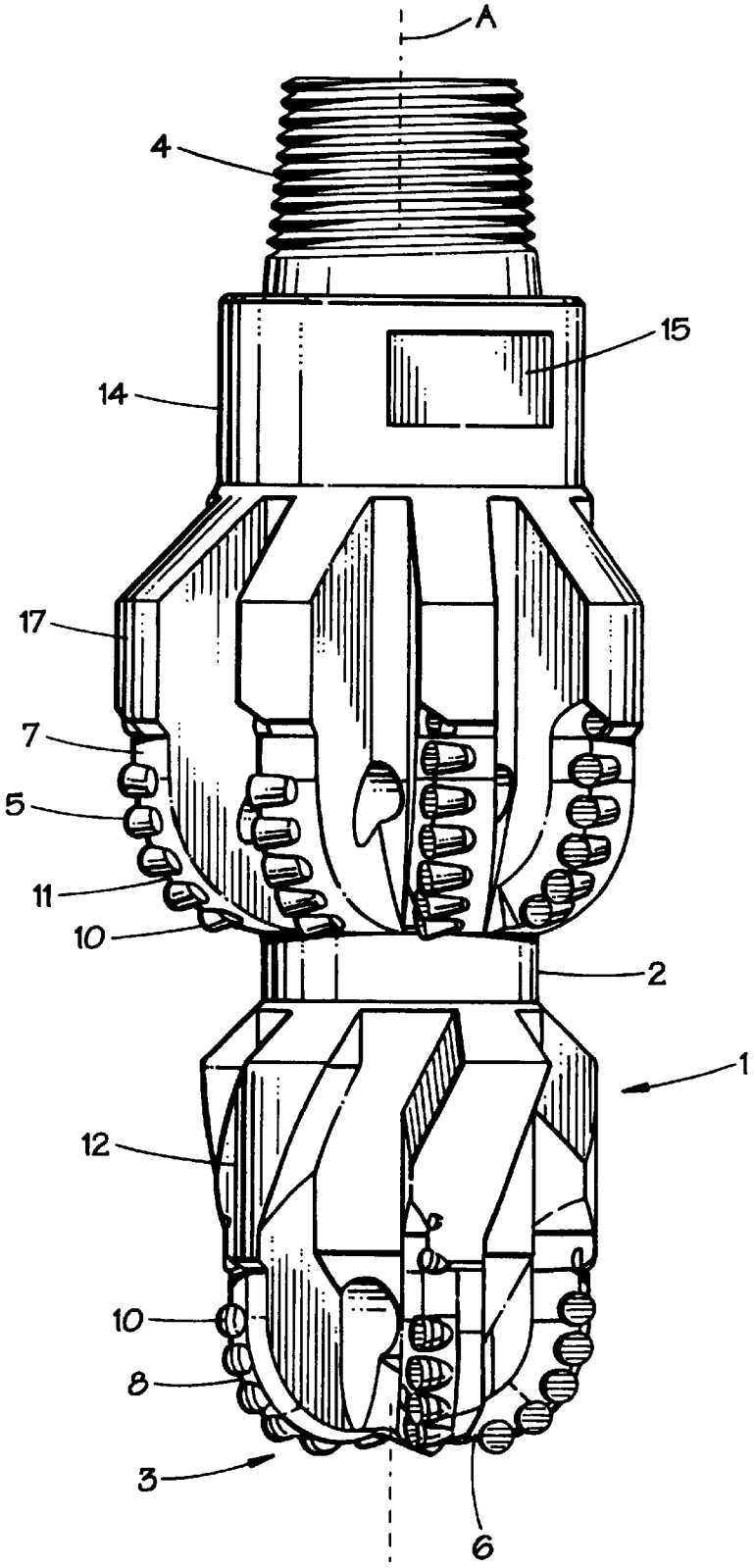
FIG. 1 ( PRIOR ART )
FIG. 1 is a side view of a conventional bi-center drill bit.

While the present invention will be described in connection with presently preferred embodiments, it will be understood that it is not intended to limit the invention to those embodiments. On the contrary, it is intended to cover all alternatives, modifications, and equivalents included within the spirit of the invention and as defined in the appended claims.

DESCRIPTION OF THE PREFERRED EMBODIMENTS

FIGS. 1–9 generally illustrate a conventional bi-center bit and its method of operating in the borehole.

By reference to these figures, bit body 2, manufactured from steel or other hard metal, includes a threaded pin 4 at one end for connection in the drill string, and a pilot bit 3 defining an operating end face 6 at its opposite end. A reamer section 5 is integrally formed with the body 2 between the pin 4 and the pilot bit 3 and defines a second operating end face 7, as illustrated. The term "operating end face" as used herein includes not only the axial end or axially facing portion shown in FIG. 2, but also contiguous areas extending up along the lower sides of the bit 1 and reamer 5.

The operating end face 6 of bit 3 is transversed by a number of upsets in the form of ribs or blades 8 radiating from the lower central area of the bit 3 and extending across the underside and up along the lower side surfaces of said bit 3. Ribs 8 carry cutting members 10, as more fully described below. Just above the upper ends of rib 8, bit 3 defines a gauge or stabilizer section, including stabilizer ribs or gauge pads 12, each of which is continuous with a respective one of the cutter carrying rib 8. Ribs 8 contact the walls of the borehole that has been drilled by operating end face 6 to centralize and stabilize the tool 1 and to help control its vibration. (See FIG. 4).

Figure 2:
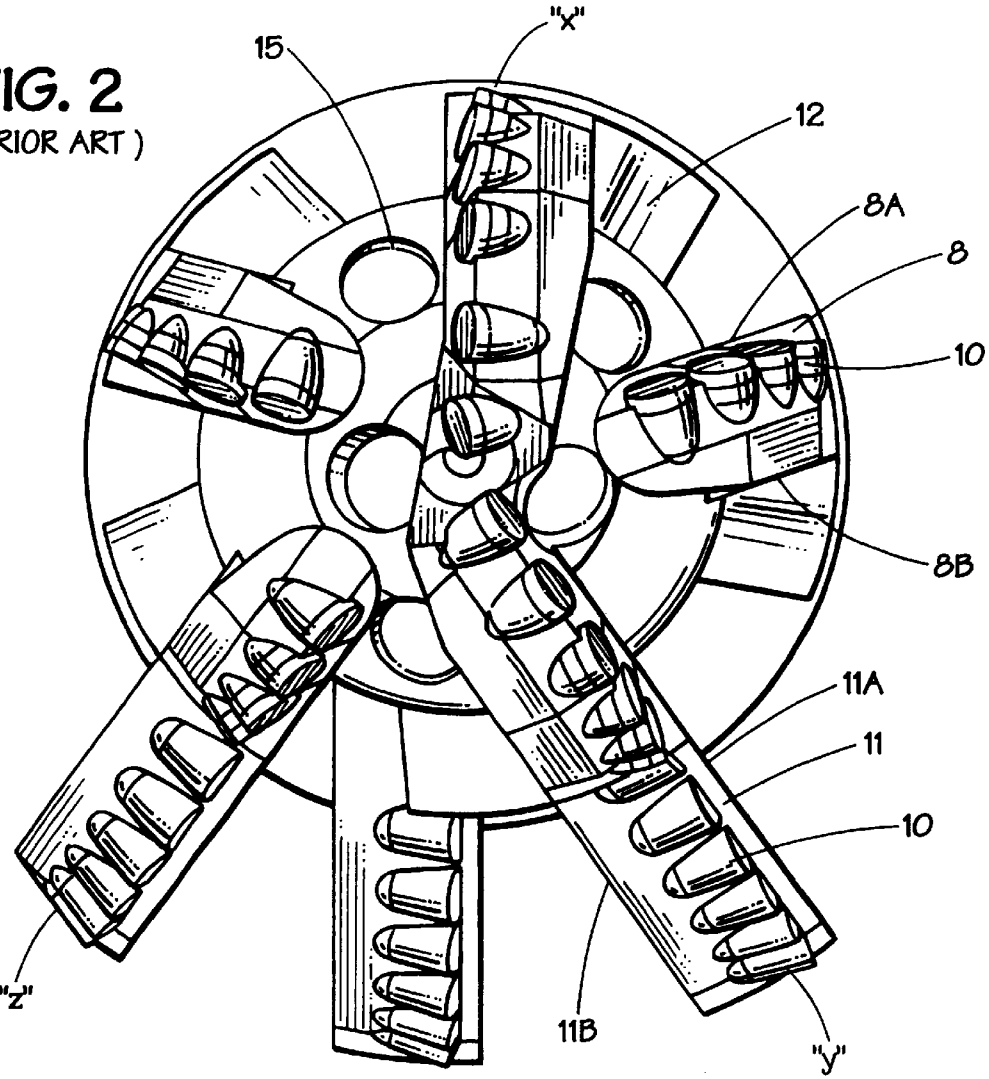
FIG. 2 ( PRIOR ART )
FIG. 2 is an end view of the working face of the bi-center drill bit illustrated in FIG. 1.
Figure 3C:
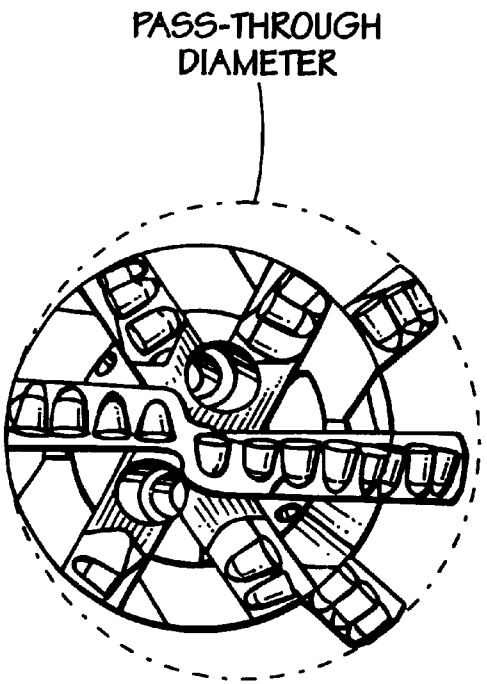
FIG. 3C ( PRIOR ART )
FIGS. 3A–C are end views of a bi-center bit as positioned in a borehole illustrating the pilot bit diameter, the drill hole diameter and pass through diameter, respectively.
Figure 3B:
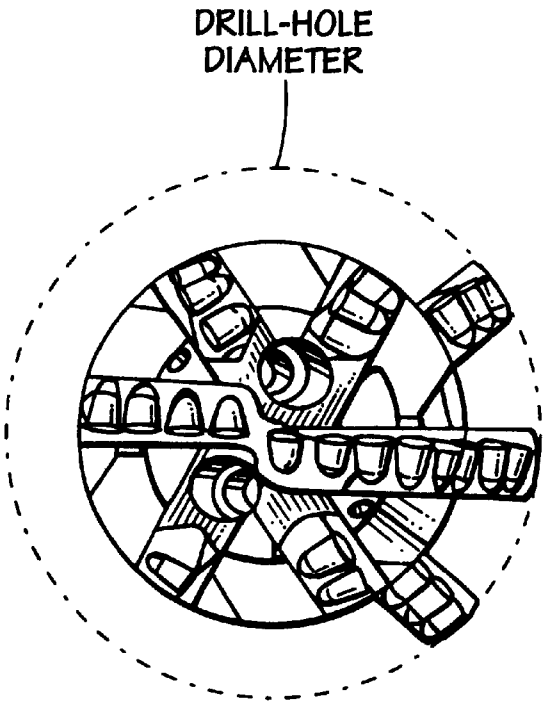
FIG. 3B ( PRIOR ART )
Figure 3A:
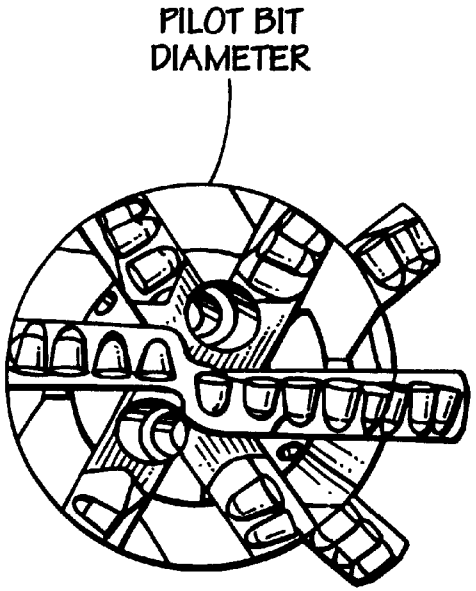
FIG. 3A ( PRIOR ART )
Figure 4B:
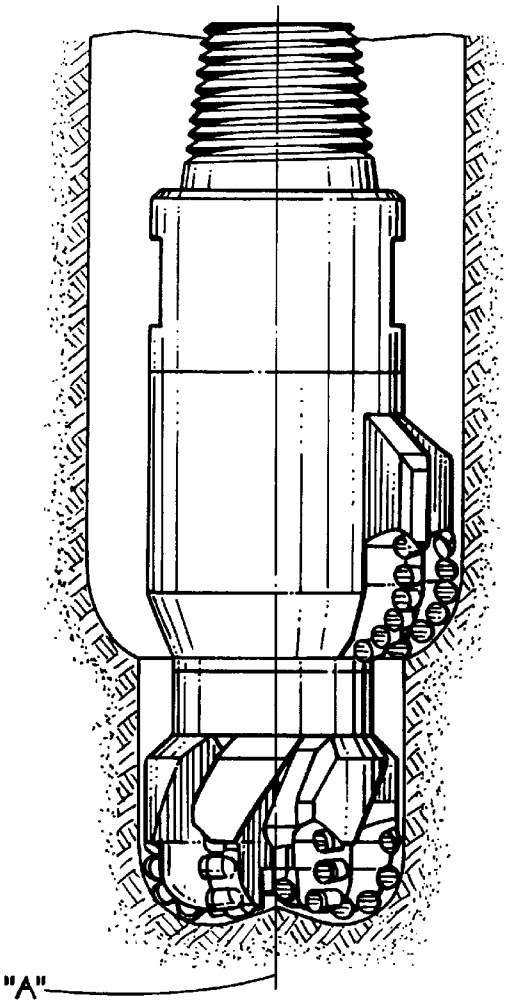
FIG. 4B ( PRIOR ART )
FIGS. 4A–B illustrate a conventional side view of a bi-center bit as it may be situated in casing and in operation, respectively.
Figure 4A:
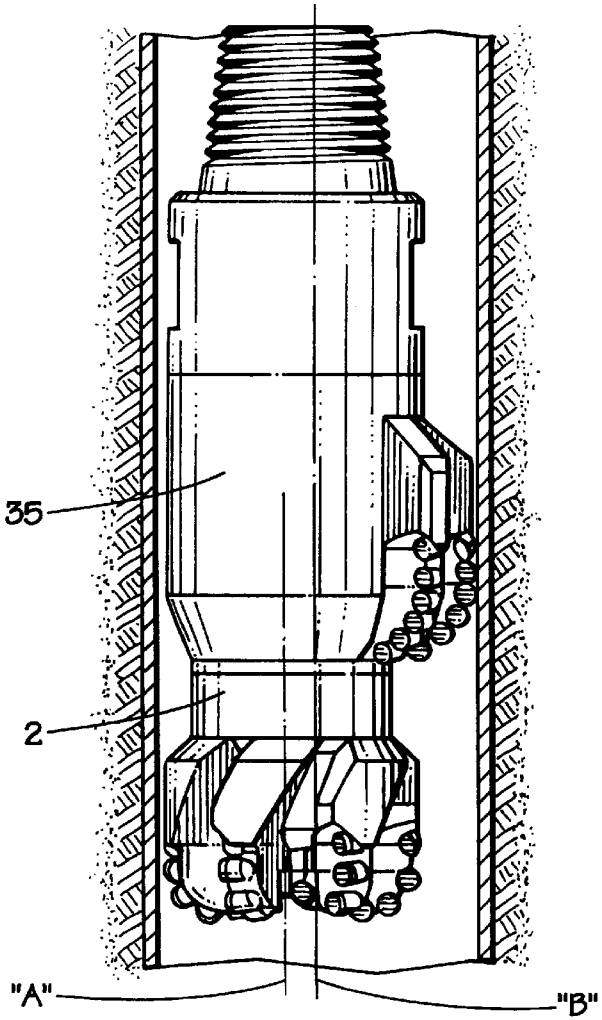
FIG. 4A ( PRIOR ART )
Figure 5:
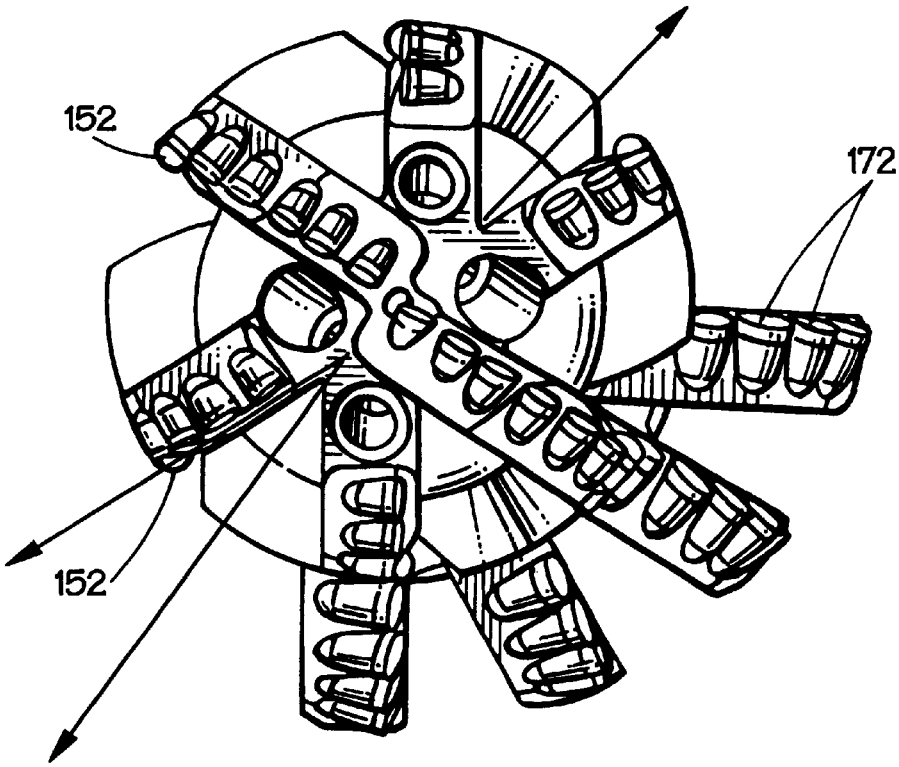
FIG. 5 ( PRIOR ART )
FIG. 5 is an end view of a conventional bi-center bit.

The pass-through diameter of the bi-center is defined by the three points where the cutting blades are at gauge. These three points are illustrated at FIG. 2 are designated "x," "y" and "z." Reamer section 5 includes two or more blades 11 which are eccentrically positioned above the pilot bit 3 in a manner best illustrated in FIG. 2. Blades 11 also carry cutting elements 10 as described below. Blades 11 radiate from the tool axis but are only positioned about a selected portion or quadrant of the tool when viewed in end cross section. In such a fashion, the tool 1 may be tripped into a hole having a diameter marginally greater than the maximum diameter drawn through the reamer section 5, yet be able to cut a drill hole of substantially greater diameter than the pass-through diameter when the tool 1 is rotated about the geometric or rotational axis "A." The axis defined by the pass-through diameter is identified at "B." (See FIGS. 4A–B.)

In the conventional embodiment illustrated in FIG. 1, cutting elements 10 are positioned about the operating end face 7 of the reamer section 5. Just above the upper ends of rib 11, reamer section 5 defines a gauge or stabilizer section, including stabilizer ribs or kickers 17, each of which is continuous with a respective one of the cutter carrying rib 11. Ribs 11 contact the walls of the borehole that has been drilled by operating end face 7 to further centralize and stabilize the tool 1 and to help control its vibration.

Intermediate stabilizer section defined by ribs 11 and pin 4 is a shank 14 having wrench flats 15 that may be engaged to make up and break out the tool 1 from the drill string (not illustrated). By reference again to FIG. 2, the underside of the bit body 2 has a number of circulation ports or nozzles 15 located near its centerline. Nozzles 15 communicate with the inset areas between ribs 8 and 11, which areas serve as fluid flow spaces in use.

Figure 6:
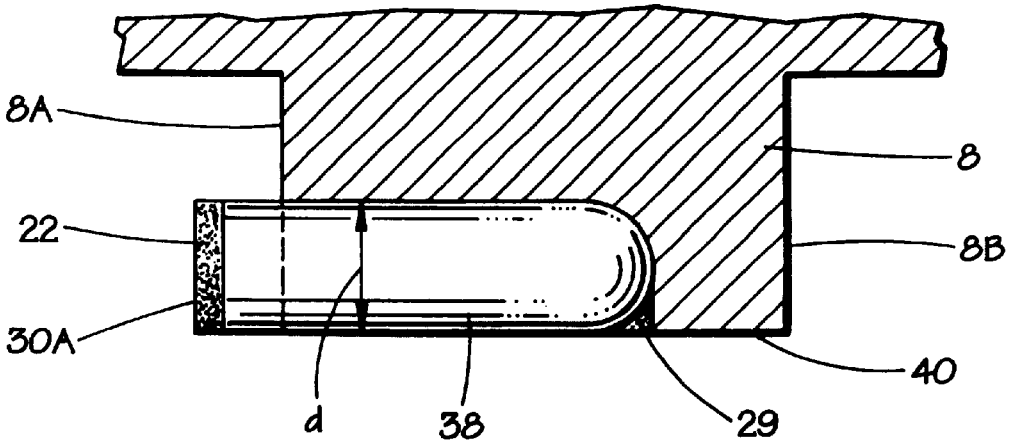
FIG. 6 ( PRIOR ART )
FIG. 6 illustrates a cutting structure brazed in place within a pocket milled into a rib of a conventional bi-center drill bit.
Figure 9:
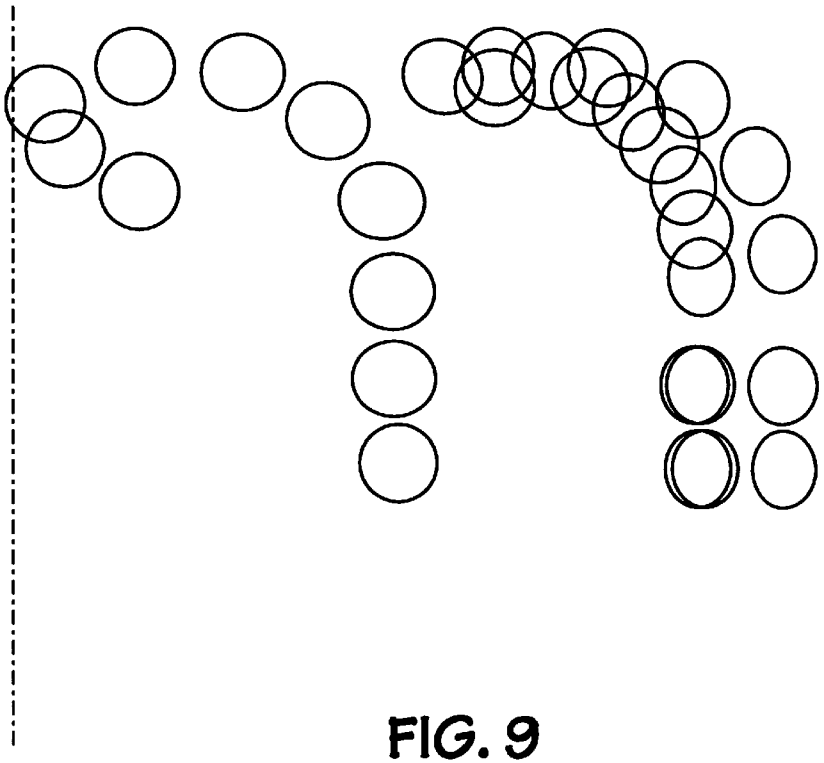
FIG. 9 (PRIOR ART)
FIG. 9 illustrates a revolved section of a conventional pilot section cutter coverage as drawn about the pass-through axis.

With reference now to FIGS. 1 and 2, bit body 2 is intended to be rotated in the clockwise direction, when viewed downwardly, about axis "A." Thus, each of the ribs 8 and 11 has a leading edge surface 8A and 11A and a trailing edge surface 8B and 11B, respectively. As shown in FIG. 6, each of the cutting members 10 is preferably comprised of a mounting body 20 comprised of sintered tungsten carbide or some other suitable material, and a layer 22 of polycrystalline diamond carried on the leading face of stud 38 and defining the cutting face 30A of the cutting member. The cutting members 10 are mounted in the respective ribs 8 and 11 so that their cutting faces are exposed through the leading edge surfaces 8A and 11, respectively.

In the conventional bi-center bit illustrated in FIGS. 1–9, cutting members 10 are mounted so as to position the cutter face 30A at an aggressive, low angle, e.g., 15–20° backrake, with respect to the formation. This is especially true of the cutting members 10 positioned at the leading edges of bit body 2. Ribs 8 and 11 are themselves preferably comprised of steel or some other hard metal. The tungsten carbide cutter body 38 is preferably brazed into a pocket 32 and includes within the pocket the excess braze material 29.

Figure 7:
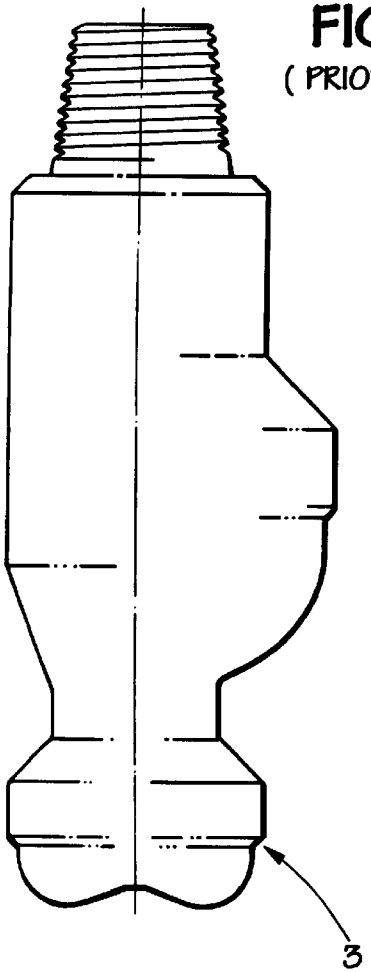
FIG. 7 ( PRIOR ART )
FIG. 7 illustrates a schematic outline view of an exemplary bi-center bit of the prior art.

As illustrated in profile in FIG. 7, the conventional bi-center bit normally includes a pilot section 3 which defines an outside diameter at least equal to the diameter of bit body 2. In such a fashion, cutters on pilot section 3 may cut to gauge.

Figure 8:
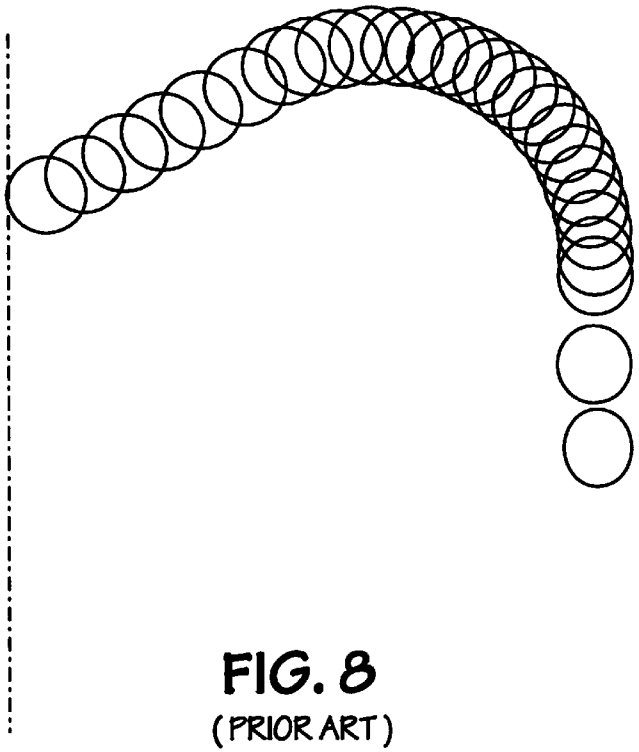
FIG. 8 (PRIOR ART)
FIG. 8 illustrates a revolved section of a conventional pilot section cutter coverage as drawn about the geometric axis.

The cutter coverage of a conventional bi-center bit may be viewed by reference to a section rotated about a given axis. FIG. 8 illustrates the cutter coverage for the pilot bit illustrated in FIGS. 1–2. The revolved section identifies moderate to extreme coverage overlap of the cutters, with the maximum overlap occurring at the crown or bottommost extent of pilot section 3 when said pilot section 3 is rotated about geometric axis "A." The cutter coverage illustrated in FIG. 8 should be compared with the absence of cutter coverage occurring when pilot section 3 is rotated about the pass-through axis "B." (See FIG. 9.) Clearly, the bi-center bit illustrated in FIG. 9 would be inefficient if used in hard or resilient formations such as a casing shoe.

When a conventional bi-center bit is rotated about its rotational axis "A," the bit performs in the manner earlier described to create a borehole having a diameter larger than its pass-through diameter. (See FIGS. 4A–4B.) This result is not desirable when the bit is used in casing to drill through a casing shoe since, while the shoe might be removed, the casing above the shoe would also be damaged. Consequently, it has become accepted practice to drill through a casing shoe using a conventional drill bit which is thereafter retrieved to the surface. A bi-center bit is then run below the casing to enlarge the borehole. However, the aforedescribed procedure is costly, especially in deep wells when many thousand feet of drill pipe may need be tripped out of the well to replace the conventional drilling bit with the bi-center bit. The bi-center bit of the present invention addresses this issue.

Figure 10:
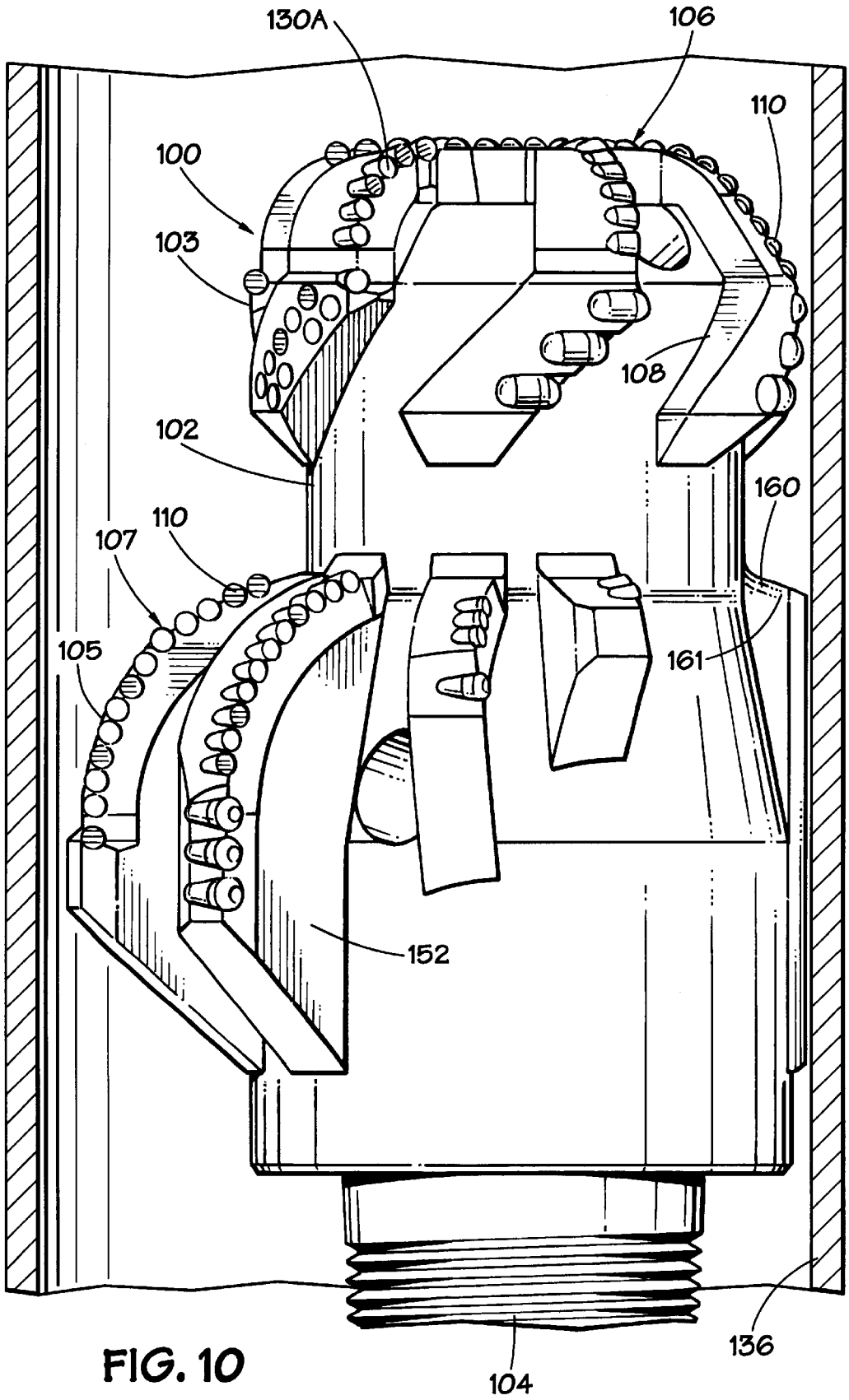
FIG. 10 illustrates a side view of one embodiment of the bi-center bit of the present invention.

One embodiment of the bi-center bit of the present invention may be seen by reference to FIGS. 10–15. FIG. 10 illustrates a side view of a preferred embodiment of the bi-center bit of the present invention. By reference to the figures, the bit 100 comprises a bit body 102 which includes a threaded pin at one end 104 for connection to a drill string and a pilot bit 103 defining an operating end face 106 at its opposite end. For reasons discussed below, end face 106 defines a flattened profile. A reamer section 105 is integrally formed with body 102 between the pin 104 and pilot bit 103 and defines a second operating end face 107.

The operating end face 106 of pilot 103 is traversed by a number of upsets in the form of ribs and blades 108 radiating from the central area of bit 103. As in the conventional embodiment, ribs 108 carry a plurality of cutting members 110. The reamer section 105 is also provided with a number of blades or upsets 152, which upsets are also provided with a plurality of cutting elements 110 which themselves define cutting faces 130A.

The embodiment illustrated in FIG. 10 is provided with a pilot section 103 defining a smaller cross-section of diameter than the conventional embodiment illustrated in FIGS. 1–8. The use of a lesser diameter for pilot section 103 serves to minimize the opportunity for damage to the borehole or casing when the tool 100 is rotated about the pass-through axis "B."

In a conventional bit, cutters 110 which extend to gauge generally include a low backrake angle for maximum efficiency in cutting. (See FIG. 11.) In the bi-center bit of the present invention, it is desirable to utilize cutting elements which define a less aggressive cutter posture where they extend to gauge when rotating about the pass-through axis. In this connection, it is desirable that cutters 110 at the pass-through gauge and positioned on the leading and trailing blades 118 define a backrake angle of between 30–90 degrees with the formation. Applicant has discovered that a preferred backrake angle for soft to medium formations is 55 degrees. The orientation of cutting elements 110 to define such high backrake angles further reduces the potential for damage to casing 136 when the tool 110 is rotated about the pass-through axis "B."

In a preferred embodiment, bit 100 may be provided with a stabilizer pad 160 opposite reamer section 105. Pad 160 may be secured to bit body 102 in a conventional fashion, e.g., welding, or may be formed integrally. Pad 160 serves to define the outer diametrical extent of tool 100 opposite pilot 103. (See FIG. 10.) It is desirable that the uppermost extent 161 of pad 160 not extend beyond the top of cutters 110 on reamer blades 152.

When rotated in the casing, the tool 100 is compelled to rotate about pass-through axis "B" due to the physical constraints of casing 136. Casing 136 is not cut since contact with tool 100 is about the three points defined by leading edges 118 and stabilizer pad 160. As set forth above, edges 118 include cutting elements having a high backrake angle not suited to cut casing 136. Likewise, pad 160 is not adapted to cut casing 136. The cutters disposed elsewhere about operating face 107 incorporate a backrake angle of 15°–30° and thus are able to cut through the casing shoe. When the casing shoe has been cut, the tool 100 is able to rotate free of the physical restraints imposed by casing 136. In such an environment, the tool reverts to rotation about axis "A."

The method by which the bi-center bit of the present invention may be constructed may be described as follows. In an exemplary bi-center bit, a cutter profile is established for the pilot bit. Such a profile is illustrated, for example, in FIG. 8 as drawn through the geometrical axis of the tool. The pass-through axis is then determined from the size and shape of the tool.

Once the pass-through diameter is determined, a cutter profile of the tool is made about the pass-through axis. This profile will identify any necessary movement of cutters 110 to cover any open, uncovered regions on the cutter profile. These cutters 110 may be situated along the primary upset 131 or upsets 132 radially disposed about geometric axis "A."

Once positioning of the cutters 110 has been determined, the position of the upsets themselves must be established. In the example where it has been determined that a cutter 110 must be positioned at a selected distance $r_1$, from pass-through axis "B," an arc 49 is drawn through $r_1$, in the manner illustrated in FIG. 15. The intersection of this arc 49 and a line drawn through axis "A" determines the possible positions of cutter 110 on radially disposed upsets 132.

To create a workable cutter profile for a bi-center bit which includes a highly tapered or contoured bit face introduces complexity into the placement of said cutters 110 since issues of both placement and cutter height must be addressed. As a result, it has been found preferable to utilize a bit face which is substantially flattened in cross section. (See FIG. 10.)

Figure 11:
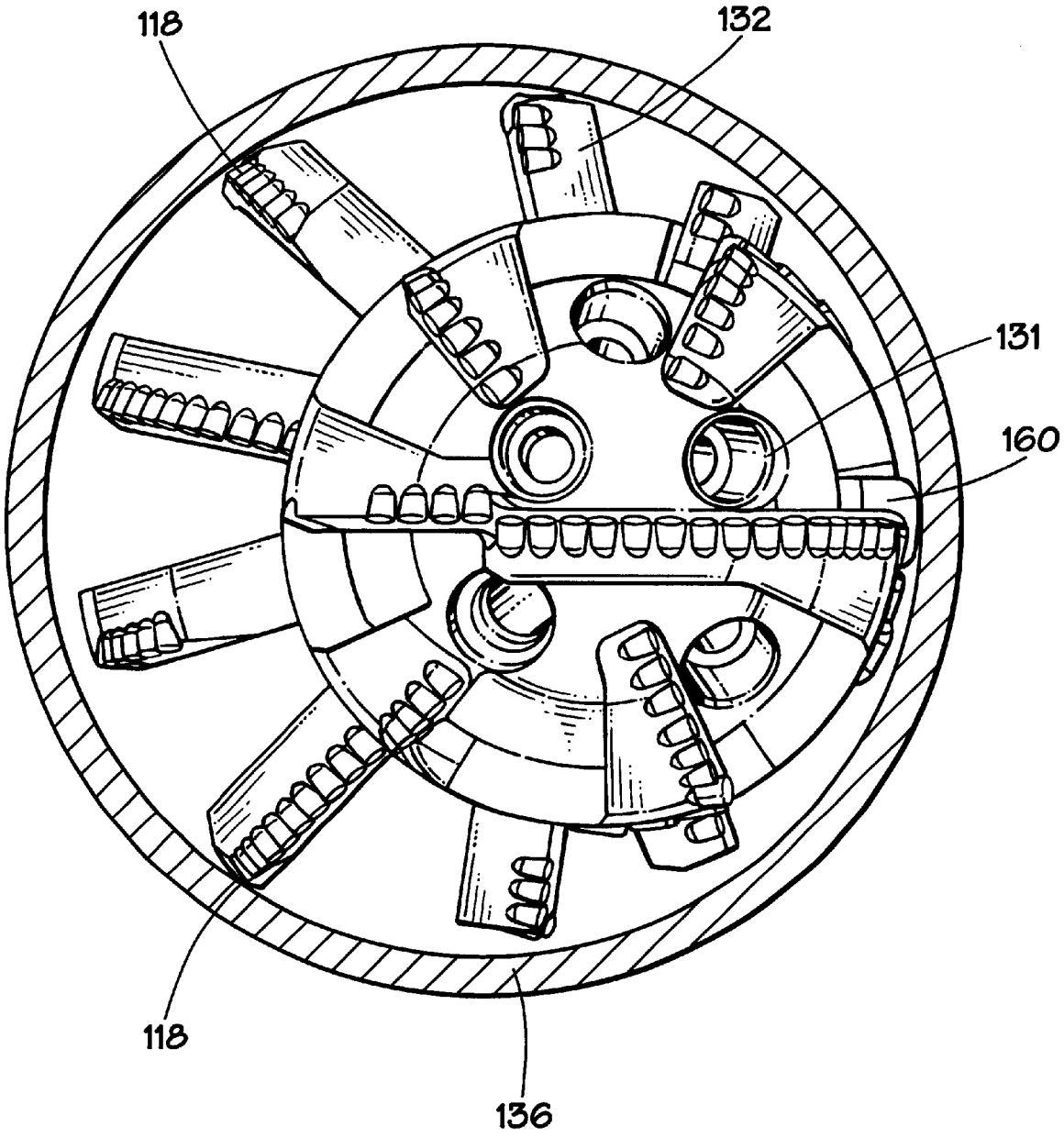
FIG. 11 illustrates an end view of the bi-center bit illustrated in FIG. 10.
Figure 13:
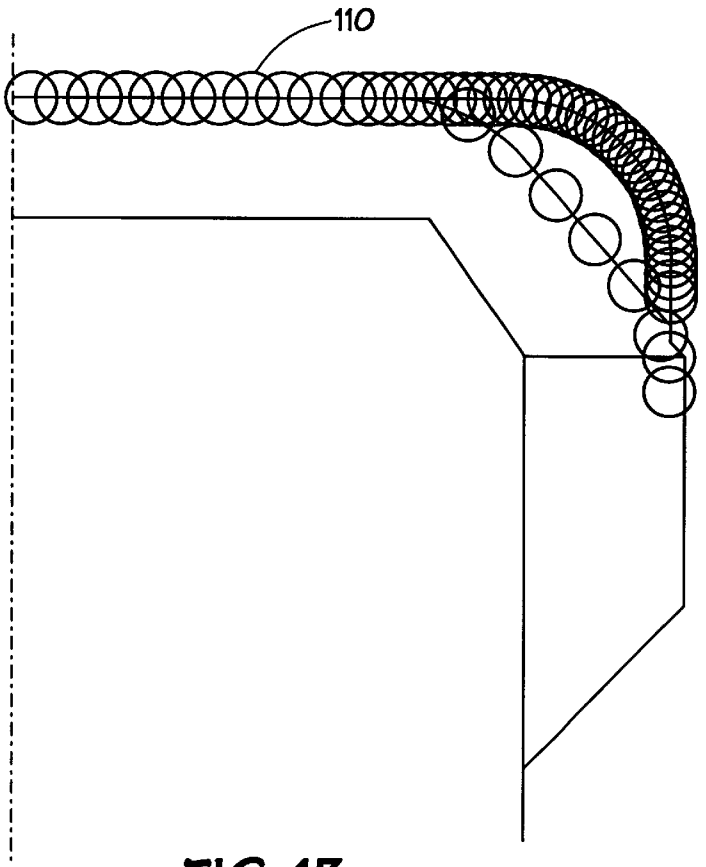
FIG. 13 illustrates a revolved section of the pilot section of the bi-center bit illustrated in FIG. 10, as drawn through the geometric axis.
Figure 12:
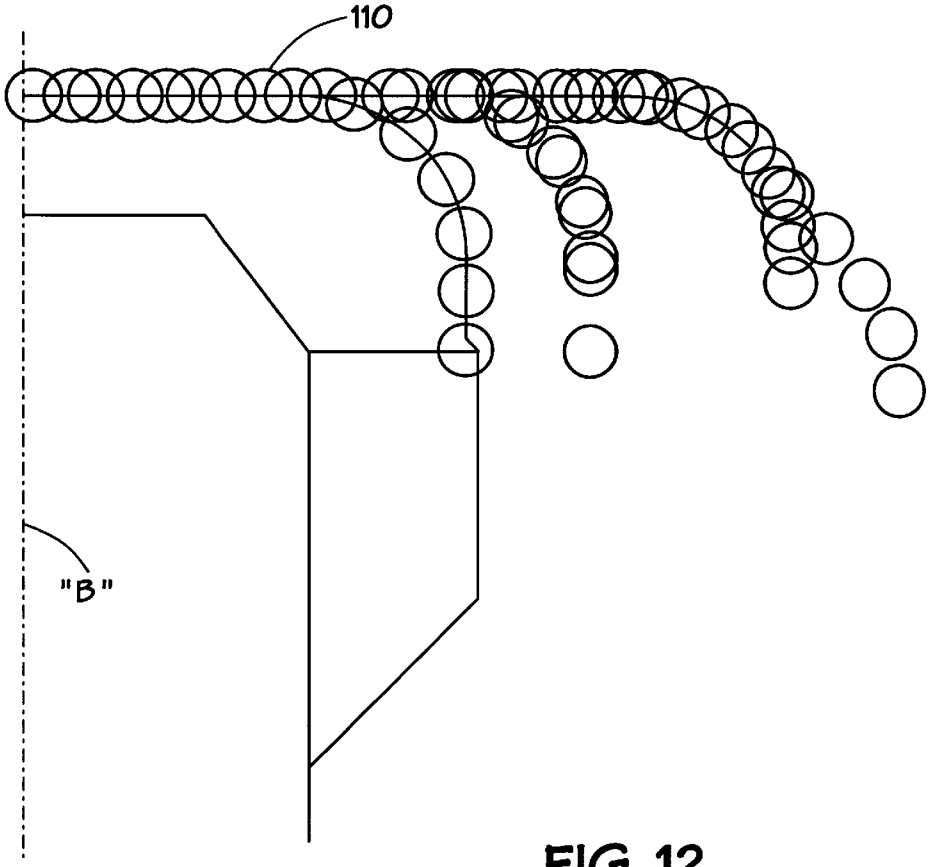
FIG. 12 illustrates a revolved section of the pilot section of the bi-center bit illustrated in FIG. 10, as drawn through the pass-through axis.
Figure 15:
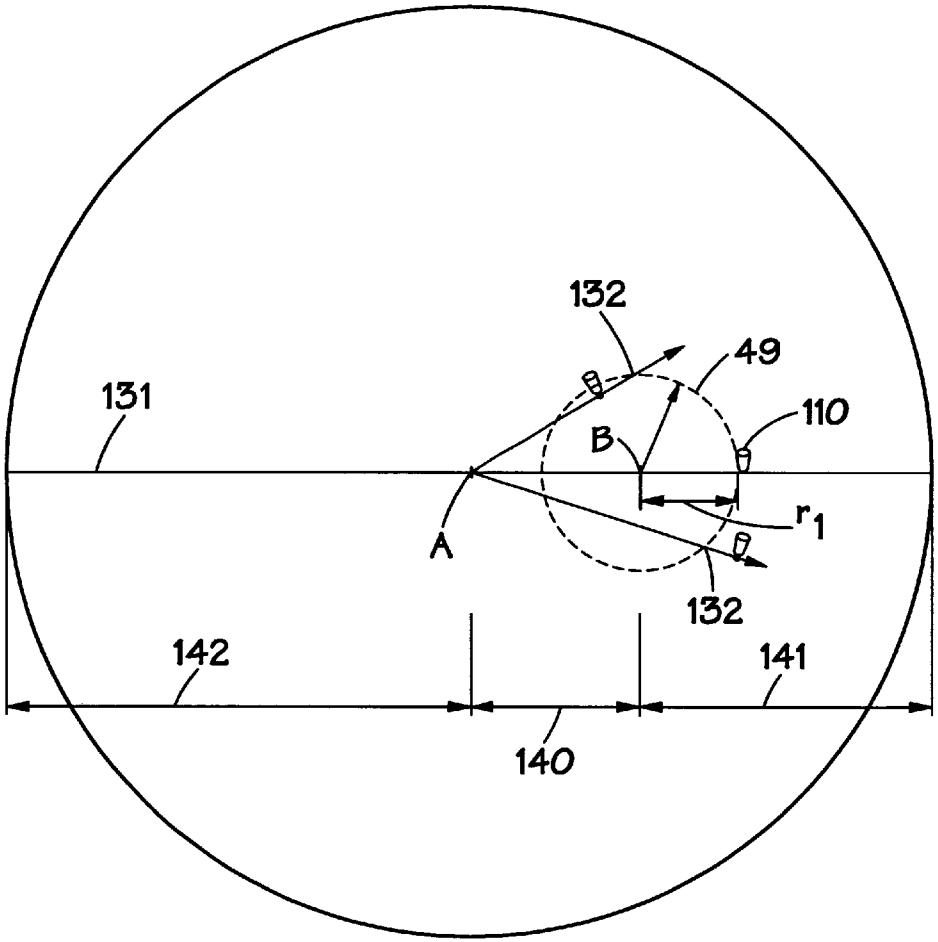
FIG. 15 illustrates a schematic view of the orientation of cutters in one preferred embodiment of the invention.
Figure 14:
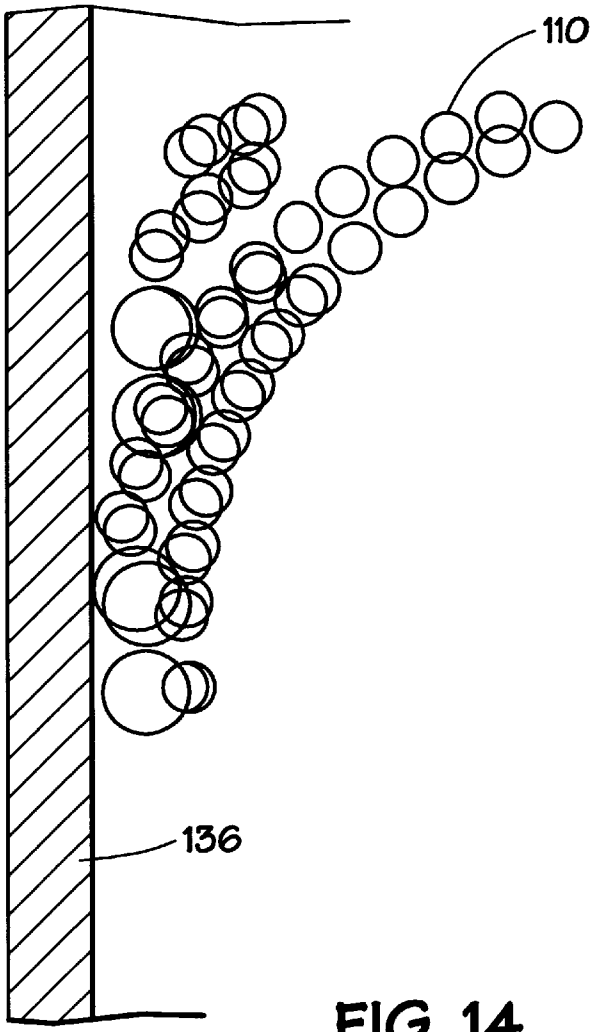
FIG. 14 illustrates a graphic profile of the cutters positioned on the reamer section of the embodiment illustrated in FIG. 10.

Once positioning of the upsets has been determined, the cutters 110 must be oriented in a fashion to optimize their use when tool 100 is rotated about both the pass-through axis "B" and geometric axis "A." By reference to FIGS. 11 and 15, cutters 110 positioned for use in a conventional bi-center bit will be oriented with their cutting surfaces oriented toward the surface to the cut, e.g., the formation. In a conventional bi-center bit, however, cutters 110 so oriented on the primary upset 131 in the area 140 between axes "A" and "B" will actually be oriented 180° to the direction of cut when tool 100 is rotated about pass-through axis "B." To address this issue, it is preferable that at least most of cutters 110 situated on primary upset 131 about area 140 be oppositely oriented such that their cutting faces 130A are brought into contact with the formation or the casing shoe, as the case may be, when tool 100 is rotated about axis "B." This opposite orientation of cutter 110 is in deference to the resilient compounds often comprising the casing shoe.

Cutters 110 disposed along primary upset 131 outside of region 140 in region 141 are oriented such that their cutting faces 130A are brought into at least partial contact with the formation regardless when rotated about axis "A." Cutters 110 oppositely disposed about primary upset 131 in region 142 are oriented in a conventional fashion. (See FIG. 15.)

Cutting or wear elements situated on blades which extend to or are proximate the pass-through gauge define a backrake angle, a skew angle and an angle between the line of contact on the cutting or wear element and the material to be drilled. This angle of contact is preferably between 5 and 45 degrees.

What is claimed is:

1. A bi-center bit adapted to be consecutively used in casing and in formation without the need of removing the bit from the borehole, said bit comprising: a bit body defining a proximal end adapted for connection to a drill string, a distal end and a pass-through gauge, where the distal end defines a pilot bit and an intermediate reamer section, where each the pilot and reamer section define a cutting face; and a plurality of cutting or wear elements situated on cutting blades disposed about the cutting face of the pilot and reamer sections, where the cutting or wear elements disposed on one or more of the blades which extend to or are proximate to the pass-through gauge define a backrake angle, a skew angle and an angle between the line of contact on the cutting or wear element and the material to be drilled of between 5–45°.

2. The bi-center bit of claim 1 further including one or more stabilizing elements disposed opposite said reamer section such that the proximal most portion of said stabilizing elements do not extend beyond the most proximally disposed cutting elements on said reamer section.

3. The bi-center bit of claim 2 where the stabilizing elements comprise a gauge pad.

4. The bi-center bit of claim 1 where the backrake angle is between 45–85°.

5. The bi-center bit of claim 2 where the stabilizing elements extend to the pass-through gauge.

6. The bi-center bit of claim 1 where the body is adapted to rotate about one axis when operated in casing and a second, independent axis when operated free of casing.

7. The bi-center bit of claim 1 where the bit body is manufactured from steel.

8. The bi-center bit of claim 1 further defining a rotational axis "A" and a pass-through axis "B" where the cutting face of most of the cutting elements disposed on cutting blades situated between the rotational axis "A" and the pass-through axis "B" are oriented such that such elements are brought into at least partial contact with the material to be drilled when the bit is rotated about said axis "B."

9. The bi-center bit of claim 1 where the cutting blades on the pilot and reamer include a primary and one or more secondary cutting blades, where both the rotational and pass-through axis are disposed about the primary cutting blade;

where each cutting element defines a cutting face; and where the cutting faces of most cutting elements disposed along the primary cutting blade not between the rotational axis "A" and pass-through axis "B" but between the pass-through axis and pass-through gauge are brought into at least partial contact with the material to be drilled when said bit is rotated about axis "B."

10. The bi-center bit of claim 9 including cutting elements positioned on the secondary cutting blades such that at least a portion of the cutting face of most elements engages the material to be drilled when the bit is rotated about axis "A."

11. The bi-center bit of claim 9 where the skew angle of said cutting elements positioned on the secondary blades is between 0–80°.

12. The bi-center bit of claim 1 where cutting elements disposed on cutting blades comprising the reamer section, other than those cutting elements disposed on cutting blades which extend to the pass-through gauge, define an angle formed between the line of contact on the cutting element and the material to be drilled of between 50–80°.

13. The bi-center bit of claim 1 where the bit body includes tungsten carbide matrix.

14. The bi-center bit of claim 6 where the cutting elements disposed about the pilot and reamer sections demonstrate substantially complete cutter overlap when the bit is rotated about either axis.

15. A two stage drilling tool comprising:

a bit body defining a proximal end adapted for connection to a drill string and a distal end where said distal end terminates in a primary bit face and a secondary bit face spaced proximally from said primary bit face where said primary bit face includes a primary upset and secondary upsets and where one or more cutting elements are disposed about said upsets;

said tool defining a rotational axis "A" and a pass-through axis "B";

where cutting elements disposed along said primary upset between said axis "A" and axis "B" define cutting faces where most of said cutter faces are brought into at least partial contact with the material to be drilled when said tool is rotated about said pass-through axis "B."

16. The drilling tool of claim 15 where both of said axes "A" and "B" are disposed along the primary upset.

17. The tool of claim 15 where the cutting faces of most of the cutting elements disposed about the primary upset not between the rotational axis "A" and pass-through axis "B" but between said pass-through axis "B" and gauge are brought into at least partial contact with the material to be drilled when said bit is rotated about either axis "A" or "B."

18. The tool of claim 15 further including the step of positioning the cutting elements on said secondary upsets such that they define a skew angle between 0–80°.

19. A bi-center bit comprising:

a bit body defining a proximal end for connection to a drill string and a distal end, where the distal end defines a pilot bit and an intermediate reamer section, where each said pilot and reamer sections each define a bit face;

the bit face on said pilot being comprised of a primary upset and one or more secondary upsets;

the bit body defining a rotational axis "A" and a pass-through axis "B"; and cutting elements disposed about said primary and secondary upsets where each of said cutting elements defines a cutting face, where most of the cutting elements disposed along the primary or secondary upsets between said rotational axis "A" and pass-through axis "B" are brought into contact with the material to be drilled when the bit is rotated about either the pass-through axis "B" or the rotational axis "A."

20. The bi-center bit of claim 19 where most of the cutting elements disposed along said primary upset not between said axis "A" and "B" but between axis "B" and the pass-through gauge are brought into at least partial contact with the formation when the bit is rotated about the rotational axis "B."

21. The bi-center bit of claim 20 where said reamer section defines leading and trailing upsets such that cutting elements positioned about said leading and trailing upsets and extending or proximate to the pass-through gauge define an effective backrake angle of between 45–85° where the effective backrake angle is equal to 180° minus the angle of contact between the cutter face and the material to be drilled and the angle of inclination of the contact surface of the cutting element.

22. The bi-center bit of claim 20 further including one or more stabilizer elements disposed opposite said reamer section where the proximal most portion of said elements does not extend beyond the proximal most cutting element on said reamer section.

23. A bit adapted to rotate about two or more rotational axes where such bit defines a pass-through gauge, said bit comprising:

a bit body defining a proximal end adapted for connection to a drill string and a distal end, where the distal end defines a pilot bit and an intermediate reamer section, where each the pilot and reamer section define a cutting face;

the bit body defining a rotational axis "A" and a pass-through axis "B"; and a plurality of cutting elements situated on cutting blades disposed about the cutting face of the pilot and reamer sections, such that there is substantially complete cutter overlap when said bit is rotated about the rotational or pass-through axis.

24. The bit of claim 23 where the cutting elements disposed proximate the pass-through gauge define a high effective backrake angle.

25. An eccentric drilling tool comprising:

a bit body defining a proximal end adapted for connection to a drill string a distal end and defining a pass-through gauge, where said distal end terminates in a primary bit face and a secondary bit face spaced proximally from said primary bit face where said primary bit face includes a primary upset and secondary upsets and where one or more cutting elements are disposed about said upsets;

said tool defining a rotational axis "A" and a pass-through axis "B" and where the cutting elements define substantially complete cutter overlap when said tool is rotated about the rotational or pass-through axes.

26. The eccentric tool of claim 25 where both of said axes "A" and "B" are disposed about the primary upset.

27. The eccentric tool of claim 25 where the cutting elements disposed proximate the pass-through gauge define a high effective backrake angle.

28. The eccentric tool of claim 25 where cutting elements disposed along said primary upset between said axis "A"

and axis "B" define cutting faces where most of said cutter faces are brought into at least partial contact with the material to be drilled when either the tool is rotated about said pass-through axis "B" or rotational axis "A."

29. A multi-bit center bit comprising:

a bit body adapted to consecutively be used to cut through casing equipment and the underlying formation without being removed from the borehole and defining a proximal end adapted for connection to a drill string and a distal end, where the distal end defines a pilot bit and an intermediate reamer section, where each the pilot and reamer section define a cutting face which include one or more cutting elements;

the bit body defining a rotational axis and at least a second axis; and where said bit when in use defines two distinct bottom hole patterns when rotated about the rotational and the second axis.

30. The bit of claim 29 where the bit defines a pass-through gauge and where cutting elements disposed proximate said gauge define a high effective backrake angle.

31. The bit of claim 29 further including one or more stabilizing elements disposed opposite the reamer section such that the proximal most portion of said stabilizing elements do not extend beyond the most proximately disposed elements on the reamer section.

32. The bit of claim 29 which is adapted to rotate in casing about an axis separate from the rotational axis so as to not pierce said casing.

33. A multi-center bit comprising:

a bit body defining a proximal end adapted for connection to a drill string and a distal end, where the distal end defines a first and a second cutting section, where each said first and second sections define a cutting face;

the bit body defining a first and second axis;

a plurality of cutting elements situated on cutting blades disposed about the cutting face of the first and second sections; and said bit adapted to consecutively without removal rotate about said axis first within casing without cutting said casing and rotating about second axis within a borehole formed in formation.

34. The bit of claim 33 where the rotation of the bit about the first or the second axes defines substantially complete cutter overlap.

35. The bit of claim 33 where the rotation of the bit about the first and the second axes creates at least two distinct bottom hole patterns.

* * * * *